United States Patent [19]

Georgino

[11] Patent Number: 4,856,247

[45] Date of Patent: Aug. 15, 1989

[54] ARTICLE AND METHOD FOR INSTALLING INSULATION

[76] Inventor: John M. Georgino, 1821 S. Charlotte, San Gabriel, Calif. 91776

[21] Appl. No.: 34,729

[22] Filed: Apr. 6, 1987

[51] Int. Cl.[4] ..... E04B 2/00

[52] U.S. Cl. ..... 52/404; 52/743; 52/712; 52/696

[58] Field of Search ..... 52/105, 108, 317, 361, 52/404, 407, 693, 696, 712, 715, 743

[56] References Cited

U.S. PATENT DOCUMENTS

| | | | |
|---|---|---|---|
| 1,027,425 | 5/1912 | Makowski | 52/696 |
| 1,535,220 | 4/1925 | Gallagher | 52/404 |
| 1,841,946 | 1/1932 | Gibbs | 428/181 |
| 1,852,917 | 4/1932 | Burgett | 52/696 |
| 2,043,321 | 6/1936 | Fleischer | 428/99 |
| 2,053,820 | 9/1936 | Fleischer | 428/99 |
| 2,846,760 | 8/1958 | Rohn | 52/696 X |
| 3,246,438 | 4/1966 | Harting | 52/404 |
| 3,374,596 | 3/1968 | O'Brien et al. | 52/105 X |
| 3,390,494 | 7/1968 | Chapple | 52/105 |
| 3,411,257 | 11/1968 | Yaremchuk | 52/105 X |
| 4,108,698 | 8/1978 | Brookshire | 156/60 |
| 4,244,155 | 1/1981 | Swiger | 52/442 |
| 4,471,592 | 9/1984 | MacKinnon, Jr. et al. | 52/404 |
| 4,579,303 | 4/1986 | Midlik | 248/48.2 |
| 4,660,348 | 4/1987 | LaLonde | 52/762 |

FOREIGN PATENT DOCUMENTS

| | | | |
|---|---|---|---|
| 18702 | 3/1930 | Australia | 52/712 |
| 511501 | 4/1955 | Canada | 52/696 |

OTHER PUBLICATIONS

E-Z Wire Products Co., Product Bulletins, Rogue River, Oregon, 4 sheets.

CertainTeed Specification Sheet, 1985, "Extended Flange Flame Resistant Foil", one page.

*Primary Examiner*—David A. Scherbel
*Assistant Examiner*—Michele A. Van Patten
*Attorney, Agent, or Firm*—Sheldon & Mak

[57] ABSTRACT

Article and method for efficiently and economically insulating a structure. The article comprises a flexible strip of material having a series of regularly spaced appendages. The method comprises affixing a plurality of rows of the article to regularly spaced framing members proximate a surface of the structure. Adjacent appendages of each article are attached proximate to the adjacent members. The insulation is placed across a plurality of rows of the article.

12 Claims, 1 Drawing Sheet

ARTICLE AND METHOD FOR INSTALLING INSULATION

BACKGROUND

The present invention is directed to an apparatus and method for installing insulation in a structure such as a commercial building.

Several articles and methods exist for installing insulation in structures such as commercial buildings. In general, these structures have a surface and a series of regularly spaced framing members, e.g., joists or trusses, proximate the surface. For example, in one method wire hangers are first attached to adjacent framing members. The insulation is installed by passing the insulation over at least two successive wire hangers. In another procedure, insulation is manufactured with a facing attached thereto. The facing extends beyond the width of the insulation. The extended portion of the facing also known as "external flanges") are attached to the adjacent framing members.

Present articles for installing insulation are relatively expensive. In addition, methods employing these articles are relatively labor intensive.

Accordingly, there is a need for a relatively inexpensive article that can be employed in a relatively non-labor intensive method for installing insulation in structures.

SUMMARY

The present invention satisfies these needs by providing (a) a relatively inexpensive article for use in (b) a relatively non-labor intensive method for installing insulation in a structure.

According to this invention, the article is employed for securing insulation within the structure. The structure has a surface and a series of regularly spaced framing members proximate the surface. The article comprises a flexible strip of material having a series of regularly spaced appendages. The distance between adjacent appendages is substantially the same as the distance between adjacent framing members. The length of each appendage is such that the article is capable of securely holding the insulation in place when the adjacent appendages are attached to the adjacent framing members.

As a safety precaution, the material employed in the article is preferably flame-retarded. For sake of compactness, the material employed in the article is preferably capable of being coiled so that the article can be packaged in the form of a compact roll. An exemplary material is plastic.

For ease in installation, it is preferred that the length of each appendage be substantially uniform. For the same reason it is preferred that at least one, and more preferably a plurality, of the appendages have indicia thereon graduating the length thereof. Similarly, the article preferably has a width capable of being readily handled by a single worker.

The article is employed in a method for insulating the structure. This method comprises securely holding the insulation in place with at least one, and preferably a plurality, of the flexible strips of material.

To avoid having the insulation shift its position after installation, it is preferred that the surface of the structure be substantially horizontal.

In an exemplary method of the present invention, the insulation is installed by affixing a plurality of rows of the flexible material to the regularly spaced framing members. The affixing step is performed by attaching the adjacent appendages in each row of material proximate the adjacent framing members. The insulation is placed between the adjacent framing members and across a plurality of rows of the flexible material. By this method, the insulation is held securely in place between the surface, the adjacent members, the adjacent appendages attached to the adjacent framing members, and a portion of the flexible material connecting the adjacent appendages.

Accordingly, a structure can be insulated in a relatively non-labor intensive method employing relatively inexpensive articles via the teachings of the present invention.

DRAWINGS

These and other features, aspects, and advantages of the present invention will become better understood with reference to the following description appended claims and accompanying drawings where:

DESCRIPTION

Figure 1:
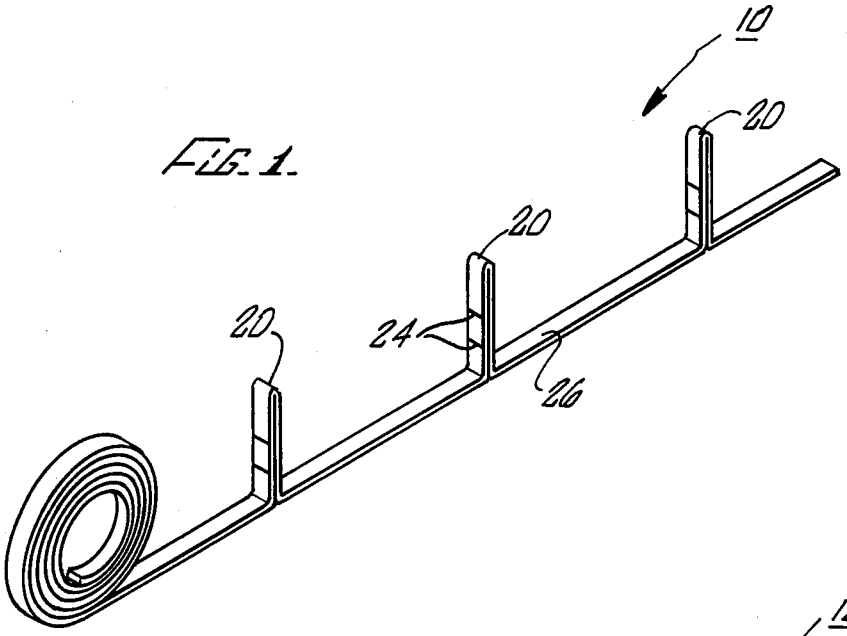
Fig. 1 is an elevation view of an article embodying features of the present invention.
Figure 3:
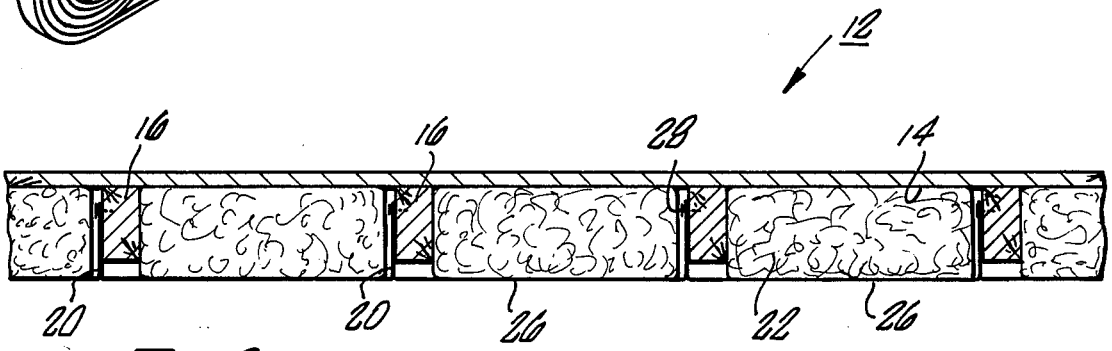
FIG. 3 is a sectional view of the structure of FUG. 2 along line 3—3.
Figure 2:
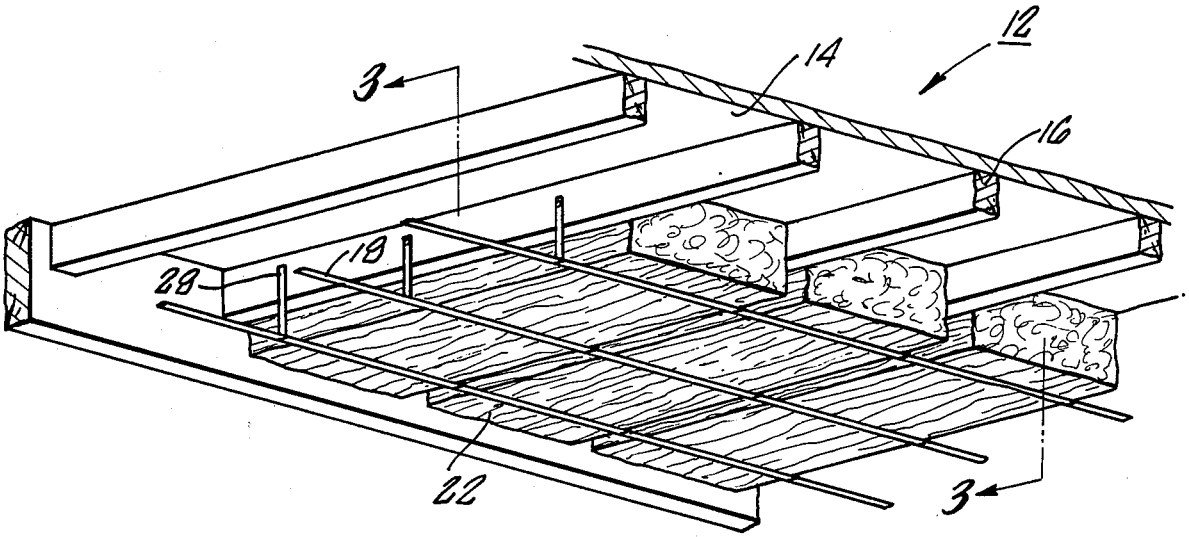
FIG. 2 is a perspective elevational view of a structure embodying features of the present invention.

The present invention is directed to (a) an article for securing insulation within a structure (b) a method for insulating the structure and (c) the insulated structure. The method and article of this invention reduce the cost of insulating the structure.

With reference to the figures, the present invention provides a relatively inexpensive article 10 capable of being employed in a relatively non-labor intensive method for insulating a structure 12. The structure 12 has a surface 14 and a series of regularly spaced framing members 16 proximate the surface 14. The article 10 comprises a flexible strip 18 having a series of regularly spaced appendages 20. The distance between adjacent appendages 20 is substantially the same as the distance between adjacent framing members 16. Since the distance between the adjacent framing members 16 varies according to the structure 12 in which they are employed, the distances between the adjacent appendages 20 can also vary. Typical distances between the framing members 16 are about 12, about 16, about 24, about 32, and about 48 inches. Accordingly, these distances also represent exemplary distances between the adjacent appendages 20.

The length of each appendage 20 is selected such that the article 10 is capable of securely holding insulation 22 in place when the adjacent appendages 20 are attached to the adjacent members 16. For ease in use, the length of each appendage 20 is preferably at least as long as the thickness of the insulation 22 to be installed in the structure 12. Typical insulation 22 thickness is from about 2 inches to about 14 inches. In order to minimize the number of different articles 10 necessary to have in stock, it is preferred that the appendages 20 have a length which encompasses several typical insulation 22 thicknesses. Accordingly, exemplary appendage 20 lengths are about 6, about 12, and about 18 inches. Preferably, the length of each appendage 20 is substantially uniform. Optionally, to further facilitate the installation of the insulation 22 each appendage 20 has indicia 24 thereon indicating gradations of length. Exemplary indicia 24 include numerical and color markings.

To also facilitate the use of article 10, it is preferred that the width of the article 10 be capable of being readily handled by a single worker. An exemplary article 10 width is from about one to about 2 inches.

To ensure the safety of the insulated structure 12, it is preferred that the article 10 be made of a flame-retarded material. It is also preferred that the article 10 be constructed of a material which is capable of being coiled so that the article 10 can be compactly packaged in the form of a roll. Additionally, for ease of manufacture and low cost, it is preferred that the material be plastic. Exemplary plastics, which are capable of being flame retarded and coiled, include polyester, polyethylene, polyvinyl chloride, and polyvinylidine chloride.

The insulation 22 is securely held in place in the structure 12 with at least one flexible strip 18 of material. Generally, the insulation 22 is securely held in place with a plurality of the flexible strips 18. In one embodiment of the present invention, a plurality of rows (not shown) of the flexible strip 18 of material are affixed to the regularly spaced framing members 16. The insulation 22 is placed between adjacent members 16 and across a plurality of the rows of the flexible material 18. The insulation 22 is securely held in place between the surface 14, the adjacent members 16, the adjacent appendages 20 attached to the adjacent members 16, and a portion 26 of the flexible strip 18 connecting the adjacent appendages 16. The appendages 20 are secured to the framing members 16 by attachment means 28. Exemplary attachment means 28 include, but are not limited to, nails, staples, and adhesives.

The relatively inexpensive article 10 and relatively non-labor intensive method of the present invention reduce the cost of insulating the structure 12.

Although the present invention has been described in considerable detail with reference to certain preferred versions thereof, other versions are possible. For example, the material employed in the manufacture of the article 10 can optionally be a flame-retarded fabric. Therefore, the spirit and scope of the appended claims should not necessarily be limited to the description of the preferred versions contained herein.

What is claimed is:

1. An article for securing insulation within a structure, the structure having a surface with a substantial horizontal component and a plurality of framing members proximate the surface, the framing members being substantially parallel to each other and regularly spaced apart from each other by a first distance, the article comprising a strip of material for securely holding the insulation in place between the strip and the surface having the substantial horizontal component and between adjacent framing members, the strip of material being sufficiently flexible to be coiled without tools, the article further having a plurality of appendages for attaching to the framing members, the appendages projecting outwardly from the strip and being regularly spaced apart from each other by a second distance, the first and second distances being substantially equal, each appendage having a length sufficiently long so that adjacent appendages are capable of being securely attached by attachment means to the adjacent framing members.

2. The article of claim 1 wherein the article is made of flame retarded material.

3. The article of claim 1 wherein the article is coiled.

4. The article of claim 1 wherein the article is made of plastic.

5. The article of claim 1 wherein the length of each appendage is substantially uniform.

6. The article of claim 1 wherein at least one appendage has indicia thereon indicating graduations of length.

7. The article of claim 1 wherein the strip of material has a width capable of being readily handled by a single worker.

8. The article of claim 1 wherein the surface is substantially horizontal.

9. The article of claim 1 wherein the length of the appendages is at least as long as a thickness of the insulation.

10. A method for installing sections of insulation in a structure, the structure having a surface with a substantial horizontal component and a plurality of framing members proximate the surface, the framing members being substantially parallel to each other and regularly spaced apart from each other by a first distance, the method comprising the steps of:

(a) affixing at least one article to the structure, each article comprising a strip of material sufficiently flexible to be coiled without tools, and a plurality of appendages projecting outwardly from the strip, the appendages being regularly spaced apart from each other by a second distance, the first and second distances being substantially equal, the appendages being attached to the framing members, each appendage having a length sufficiently long so that adjacent appendages are securely attached by the attachment means to the adjacent framing members;

(b) placing one of the sections of insulation securely between the strip of each article and the surface having the substantial horizontal component and between adjacent framing members; and (c) repeating step (b) until each section of insulation is installed.

11. The method of claim 10 wherein the surface is substantially horizontal.

12. The method for installing sections of insulation of claim 10 wherein the appendages have lengths at least as long as a thickness of the sections of insulation.

* * * * *